United States Patent [19]

Wechner

[11] Patent Number: 4,828,327

[45] Date of Patent: May 9, 1989

[54] BIT HOLDER FOR MINER

[75] Inventor: Edward Wechner, Minnamurra, Australia

[73] Assignee: Joy Technologies Inc., Pittsburgh, Pa.

[21] Appl. No.: 161,506

[22] Filed: Feb. 29, 1988

[30] Foreign Application Priority Data

Mar. 19, 1987 [AU] Australia ..... PI0955

[51] Int. Cl.[4] ..... E21B 35/18

[52] U.S. Cl. ..... 299/91; 299/93

[58] Field of Search ..... 299/79, 86, 91, 93; 37/142 R; 407/46, 47, 101, 102, 120

[56] References Cited

FOREIGN PATENT DOCUMENTS 1266137 3/1972 United Kingdom ..... 299/93

2153878 8/1985 United Kingdom ..... 299/79

*Primary Examiner*—Jerome W. Massie
*Assistant Examiner*—David J. Bagnell
*Attorney, Agent, or Firm*—Kirkpatrick & Lockhart

[57] ABSTRACT

A pick holder for a miner comprising a mounting base and a bit holder detachably mounted to the mounting base by way of a substantially vertical join face. The join face incorporates a pair of mating faces on each of the mounting base and bit holder inclined relative to the longitudinal plane of the pick holder and forming an arrowhead formation with a pair of shoulders parallel to the longitudinal plane. The bit holder is secured to the mounting base by a longitudinal bolt a significant length allowing a desired degree of strain to be induced in the bolt during attachment.

7 Claims, 2 Drawing Sheets

BIT HOLDER FOR MINER

BACKGROUND OF THE INVENTION

This invention relates to a bit holder for a miner and has been devised particularly though not soley for mounting on the cutting drums of continuous mining machines.

Continuous mining machines commonly incorporate various types of rotating cutting drums on which are mounted a plurality of bits or picks pointing outwardly from the surface of the drum and arranged such that when the drum is rotated against a face (e.g. a coal face) the bits or picks strike the face and sever the minerals therefrom. The bits are fastened to the drum by way of a pick holder which is commonly in two parts, a mounting base normally welded to the surface of the drum and a bit holder secured to the mounting base by way of detachable means such as a transverse pin or a set screw. Many of the pick holders currently in use develop degrees of wear after a short period of time allowing the bit to move or wobble relative to the drum, reducing the cutting efficiency of the miner and causing further accelerated wear in the bit and the pick holder. Attempts have been made to overcome these problems by providing pick holders with widened "ears" to provide a broader mounting base for the bit and also by providing various different types of clamping devices which will enable the bits to be readily removed and replaced as they wear while yet providing a firm location of the bit holder in the mounting base. Those pick holders incorporating the wide ears have problems in that the ears wear in use and also absorb cutting power from the mining machine as they contact the coal face. This problem is particularly acute in pick holders mounted on the cutting drum at the edges of the drum where the pick holder is bent over at an angle in order to cut into the corners, or where they are located next to the core breaker on hard head mining machines.

It is a further problem with existing pick holders that frequent tightening of the mounting set screw is necessary in order to maintain the integrity of the mounting of the bit holder in the mounting base and neglect of the tightening procedure can result in a loose bit holder and rapidly accelerated wear.

Many existing pick holders are also of comparatively low profile and require to be mounted on pedestals welded to the cutting drum in order to achieve the desired height of the point of the bit above the drum surface.

BRIEF SUMMARY OF THE INVENTION

The present invention therefore provides a pick holder for a mining machine comprising a mounting base having a lower face adapted to be fastened directly or indirectly to the drum or other cutting device of the mining machine, and a bit holder detachably mounted to the mounting base and incorporating a mounting aperture for a bit arranged such that a bit located in the mounting aperture would be located on and aligned with a central plane extending through the bit holder and mounting base, characterised by the provision of a join face between the mounting base and the bit holder extending transversely across the central plane and being generally substantially perpendicular or steeply inclined relative to the lower face of the mounting base, and wherein the bit holder is supported from the mounting base by way of portions of the join face forming a pair of mating faces on each of the mounting base and bit holder positioned remotely from the lower face of the mounting base and toward the edges of the join face away from the central plane, the mating faces being inclined relative to the central plane and to the join face.

Preferably the mating faces are inclined in an arrowhead configuration pointing toward the location of the point of a bit mounted in the mounting aperture.

Preferably the inner edges of the mating faces on the mounting base terminate in shoulders parallel to the central plane but spaced outwardly therefrom and extending away from the location of the point of the bit, and the inner edges of the mating faces on the bit holder terminate in similar shoulders forming a sliding fit within the shoulders of the mounting base such that the shoulders define a central shaft of the aforesaid arrowhead configuration.

Preferably the bit holder is also supported on the mounting base by way of a pair of corresponding pads on each of the mounting base and bit holder located adjacent the lower face of the mounting base.

Preferably the bit holder is secured to the mounting base by way of a bolt having its axis in the central plane located between the mounting faces and the pads, and extending from the leading face of the bit holder to the trailing face of the mounting base.

Preferably the mounting base is sufficiently deep from the join face to the trailing face that the bolt is sufficiently long to enable a desired degree of strain to be tensioned therein upon tightening of the bolt.

BRIEF DESCRIPTION OF THE DRAWINGS

Notwithstanding any other forms that may fall within its scope, one preferred form of the invention will now be described by way of example only with reference to the accompanying drawings, in which.

DETAILED DESCRIPTION OF THE PREFERRED EMBODIMENT

Figure 1:
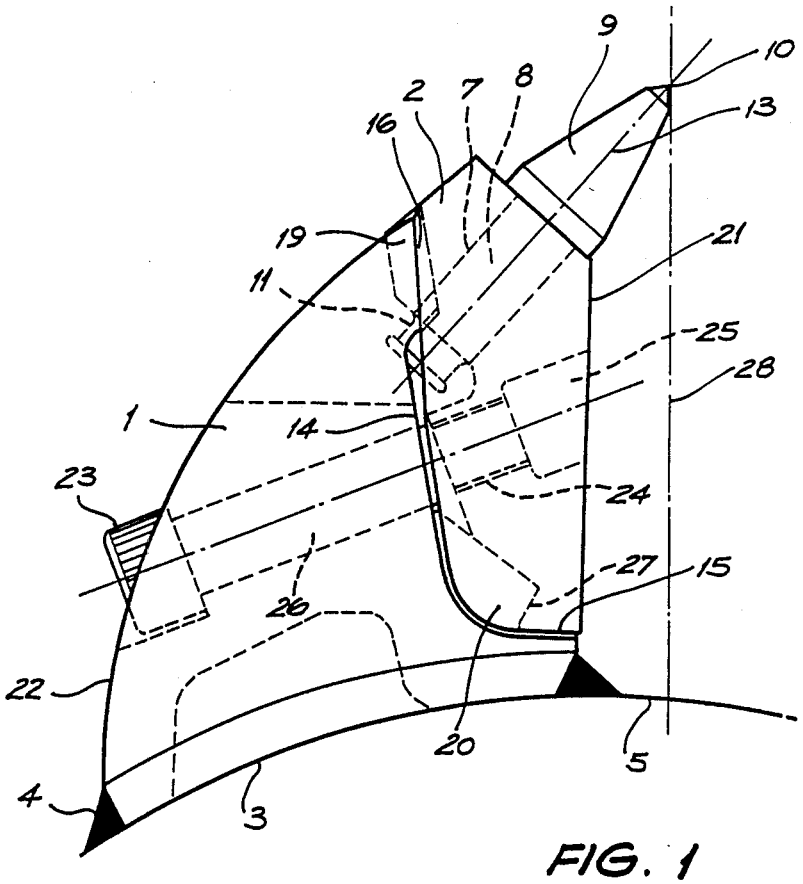
FIG. 1 is a side elevation of a pick holder according to the invention mounted on the cylindrical face of a cutting drum.

In the preferred form of the invention a pick holder suitable for mounting on the cylindrical face of the cutting drum of a miner will be described, although it will be appreciated that the pick holder can also be adapted for use in other situations such as mounting on the end face of a sump cutter drum or on the chains of a Ripperveyor cutting chain.

The pick holder comprises two components, namely a mounting base 1 and a bit holder 2. The mounting base has a lower face 3 which is typically welded around its periphery by way of filet welds 4 to the cylindrical surface 5 of a cutting drum. To this end the lower face of the mounting base is typically chamfered as shown at 6.

The bit holder is provided with a mounting aperture 7 designed to receive the shank 8 of a bit 9 which typically has a conical configuration terminating in a point 10. The bit is typically held in place in the mounting aperture by way of Circlip retaining clip (not shown) about a groove 11 on the inner end of the bit.

The pick holder is generally symmetrical about a central plane 12 with the axis 13 and point 10 of the bit located in the central plane.

The bit holder and mounting base are mated together along a join face 14 which extends transversely across the central plane 12 and which is generally substantially perpendicular or steeply inclined relative to the lower face 3 of the mounting base. In the example shown in the accompanying drawings the join face is substantially perpendicular to the lower face 3 over most of its length, terminating in an outwardly curved portion 15 toward the lower end.

Figure 2:
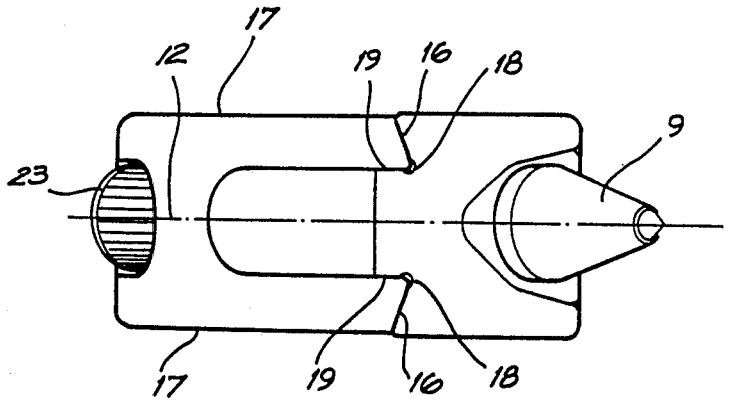
FIG. 2 is a plan view of the pick holder shown in FIG. 1.
Figure 3:
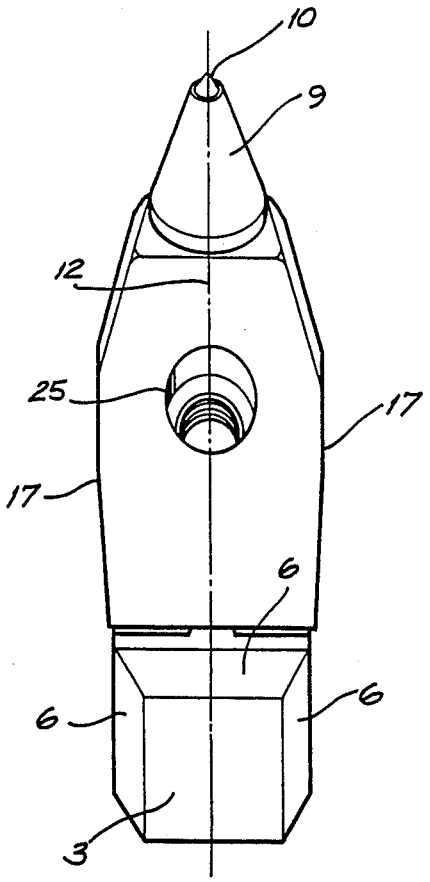
FIG. 3 is a frontal view of the pick holder shown in FIG. 1 removed from the cutting drum.

The bit holder is supported from the mounting base by way of a pair of mating faces 16 on each of the mounting base and bit holder positioned at the upper end of the join face 14 (remote from the lower face 3 of the mounting base) and toward the side faces 17 of the pick holder away from the central plane 12. The mating faces 16 are inclined relative to the central plane 12 and the join face 14 and are preferably formed in an arrowhead configuration (as can be clearly seen in FIG. 2) pointing toward the location of the point 10 of the bit 9.

The inner edges 18 of the mating faces terminate in shoulders 19 parallel to the central plane but spaced outwardly therefrom such that the shoulders form the "shaft" of the aforesaid arrowhead configuration. The shoulders on each of the mounting base and bit holder are sized such that the shoulders on the bit holder form a neat sliding fit within the shoulders of the mounting base. In this manner the bit holder is located in the mounting base at the upper end of the join face (remote from the lower face 3) by way of the mounting faces 16 and shoulders 19.

At the lower end of the join face, the bit holder is located and mounted in the mounting base by way of a pair of pads located on either side of a central buttress 20. The bit holder is secured to the mounting base by way of a bolt 26 positioned in the central plane 12 and located intermediate the mounting faces 16 and the pads on the buttress 20. The bolt extends from the leading face 21 of the bit holder to the trailing face 22 of the mounting base and typically has a socket head 23 and a threaded portion secured in a threaded aperture 24 tapped into the bit holder 2. Where desired, the leading face 21 of the bit holder may be recessed as shown at 25 so that the socket head may be located at the leading face of the pick holder where this is necessary for access to tighten the bolt. It is preferred however that the socket head 23 be located at the trailing edge of the pick holder so that wear from contact with the mining face is significantly reduced.

It is a feature of the invention that the mounting base 1 may be formed sufficiently deeply from the join face 14 to the trailing face 22 that the bolt 26 is sufficiently long to enable a significant degree of strain to be tensioned therein upon tightening of the bolt by the socket head 23. In this manner, sufficient tensile loading can be kept on the threaded engagement at 24 and under the head 23 to prevent inadvertent loosening of the bolt during operation.

It is a further feature of the pick holder that the lower face 27 of the buttress 20 is inclined downwardly and rearwardly, and mates with a corresponding face within a recess in the bit holder 2 such that upon tightening of the mounting bolt 26, the bit holder is automatically drawn inwardly and downwardly into its correct location relative to the mounting base 1. The pads on the buttress 20 are also sufficiently small such that the pressure on one pad only, induced by tensioning the bolt 26, will cause the crushing of the face of that pad until the second pad of the pair also takes its share of the loading, thus obviating any diagonal racking load between the pairs of mounting faces 16 and the pads on the buttress 20.

The pick holder formed according to the invention has the advantage that the reaction load from contact of the bit point 10 with the coal face is taken through the mating faces 16 evenly into the mounting base 1. Any off-centre load on the point of the pick 10 can be strongly reacted by the mating faces 16 and shoulders 19 without allowing the bit holder to wobble relative to the mounting base. This is all achieved in a very slim configuration of pick holder, reducing any contact between the pick holder and the coal face and allowing improved efficiency of operation of the mining machine.

The pick holder according to the invention is also quite suitable for mounting at inclined angles on the cutting drum, e.g. at the edge of the drum or adjacent the web on a hard head machine as there are no protruding "ears" to interfere with the coal face. The pick holder can also be readily manufactured to have a significant height 28 from the drum surface to the point 10 of the pick thus obviating the necesssity for separate mounting pedestals.

What I claim is:

1. A pick holder for a mining machine comprising a mounting base having a lower face adapted to be fastened directly or indirectly to the drum or other cutting device of the mining machine, and a bit holder detachably mounted to the mounting base and incorporating a mounting aperture for a bit arranged such that a bit located in the mounting aperture would be located on and aligned with a central plane extending through the bit holder and mounting base, characterised by the provision of a join face between the mounting base and the bit holder extending transversely across the central plane and being generally substantially perpendicular or steeply inclined relative to the lower face of the mounting base, and wherein the bit holder is supported from the mounting base by way of partitions of the join face forming a pair of mating faces on each of the mounting base and bit holder positioned remotely from the lower face of the mounting base and toward the edges of the join face away from the central plane, the mating faces being inclined relative to the central plane and to the join face.

2. A pick holder as claimed in claim 1 wherein the bit holder is also supported on the mounting base by way of a pair of corresponding pads on each of the mounting base and bit holder located adjacent the lower face of the mounting base.

3. A pick holder as claimed in claim 2 wherein the pads are located on either side of a central buttress extending outwardly from the join face of the mounting base into a corresponding recess in the join face of the bit holder, and wherein the lower face of the buttress and corresponding lower face of the recess are inclined downwardly toward the lower face of the mounting base, causing the bit holder to be pulled downwardly by sliding action of the lower faces over one another as the bit holder is engaged with the mounting base.

4. A pick holder as claimed in claim 2 wherein the bit holder is secured to the mounting base by way of a bolt having its axis in the central plane located between the mating faces and the pads, and extending from the leading face of the bit holder to the trailing face of the mounting base.

5. A pick holder as claimed in claim 4 wherein the mounting base is sufficiently deep from the join face to the trailing face that the bolt is sufficiently long to enable a desired degree of strain to be tensioned therein upon tightening of the bolt.

6. A pick holder for a mining machine comprising a mounting base having a lower face adapted to be fastened directly or indirectly to the drum or other cutting device of the mining machine, and a bit holder detachably mounted to the mounting base and incorporating a mounting aperture for a bit arranged such that a bit located in the mounting aperture would be located on and aligned with a central plane extending through the bit holder and mounting base, characterized by the provision of a join face between the mounting base and the bit holder extending transversely across the central plane and being generally substantially perpendicular or steeply inclined relative to the lower face of the mounting base, and wherein the bit holder is supported from the mounting base by way of partitions of the join face forming a pair of mating faces on each of the mounting base and bit holder positioned remotely from the lower face of the mounting base and toward the edges of the join face away from the central plane, the mating faces being inclined in an arrowhead configuration pointing substantially toward the location of the point of a bit mounted in the mounting aperture.

7. A pick holder as claimed in claim 6 wherein the inner edges of the mating faces on the mounting base terminate in shoulders parallel to the central plane but spaced outwardly therefrom and extending away from the location of the point of the bit, and the inner edges of the mating faces on the bit holder terminate in similar shoulders forming a sliding fit within the shoulders of the mounting base such that the shoulders define a central shaft of the aforesaid arrowhead configuration.

* * * * *